United States Patent [19]

Graham

[11] Patent Number: 5,042,797

[45] **Date of Patent: * Aug. 27, 1991**

[54] ACTIVE/PASSIVE EXERCISE APPARATUS

[76] Inventor: Gary A. Graham, P.O. Box 2000, Glacier, Wash. 98244

[ * ] Notice: The portion of the term of this patent subsequent to Nov. 17, 2004 has been disclaimed.

[21] Appl. No.: 380,671

[22] Filed: Jul. 14, 1989

Related U.S. Application Data

[63] Continuation of Ser. No. 83,044, Aug. 10, 1987, abandoned.

[51] Int. Cl.[5] ..... A63B 21/00

[52] U.S. Cl. ..... 272/120; 272/72; 272/127; 272/128; 272/134

[58] Field of Search ..... 272/72, 93, 110, 121, 272/126-128, 134, 142, 144

[56] References Cited

U.S. PATENT DOCUMENTS

| | | | |
|---|---|---|---|
| 1,247,869 | 11/1917 | Ostlin | 272/72 |
| 1,996,350 | 4/1935 | Schaff | 272/120 |
| 3,622,154 | 11/1971 | Williams | 272/134 |
| 3,770,267 | 11/1973 | McCarthy | 272/72 |
| 4,101,124 | 7/1978 | Mahnke | 272/144 |
| 4,198,045 | 4/1980 | Miller | 272/142 |
| 4,272,074 | 6/1981 | Sefrle | 272/120 |
| 4,706,953 | 11/1987 | Graham | 272/120 |

FOREIGN PATENT DOCUMENTS

| | | | |
|---|---|---|---|
| 667083 | 9/1964 | Italy | 272/72 |
| 469155 | 12/1928 | United Kingdom | 272/72 |
| 2407907 | 8/1975 | United Kingdom | 272/134 |

*Primary Examiner*—Richard J. Apley
*Assistant Examiner*—D. F. Crosby
*Attorney, Agent, or Firm*—Delbert J. Barnard

[57] ABSTRACT

In the subject apparatus the user lies, back down, on a shuttle platform which is mounted on parallel tracks and movable from end to end of the tracks. The shuttle is biased toward a position between the ends by primary and secondary energy storage and release apparatuses.

The engagement of the shuttle and track assembly by the primary energy storage and release apparatus is constant. The secondary energy storage and release apparatus is constantly engaged with the shuttle and intermittently engaged with the track assembly. Both apparatuses are adjustable in terms of the at rest position of the shuttle on the track assembly and the forces in the apparatuses when at rest and in operation.

Hand grips are attached to the track assembly by cables and are used by the user for setting the platform into oscillating motion on the track. The acceleration forces achieved may be in excess of the force of gravity and the shuttle is equipped with supports and restraints for stabilizing the position of the user on the shuttle. The exercise provides cardiovascular stimulation, passive exercise of all components of the body and the active exercise of setting the shuttle in motion and maintaining the motion.

9 Claims, 2 Drawing Sheets

ACTIVE/PASSIVE EXERCISE APPARATUS

This application is a continuation of application Ser. No. 07/083,044, filed 8/10/87 now abandoned.

BACKGROUND OF THE INVENTION

1. Field

The subject invention is in the field or exercise apparatus which comprises a platform mounted on tracks or guides and movable on the tracks in reciprocating motion. Particularly it is in the field of such apparatus which further comprises apparatus such as springs or elastic cords to influence the motion and positioning of the platform on the tracks. Still more particularly, the invention is in the field of exercise apparatus in which the user is accommodated in a supine position.

2. Prior Art

There is profuse prior art in this field. However, the closest prior art is considered to be in three earlier U.S. patent applications by the present inventor. The earlier applications are U.S. Ser. Nos. 696,254, 786,540, and 001,192, the latter being the most pertinent. The apparatus of U.S. Ser. No. 001,192 comprises a platform, termed a shuttle, being mounted on rollers which engage the tracks of a track assembly. The shuttle is further interconnected to the track assembly with primary and secondary energy storage and release systems comprising elastic cords. The tension forces in the cords of both systems are adjustable to influence the at-rest location of the shuttle on the tracks and the forces applied to the shuttle by the cords as the shuttle moves with respect to the tracks. The primary system interconnects between the shuttle and both ends of the track assembly. The secondary energy absorption and release system is in constant engagement with the track assembly and intermittent engagement with the shuttle, the shuttle engaging the secondary system when the shuttle approaches one or both the extreme of its reciprocating motion on the tracks.

It has been determined in the course of development work on the exercise apparatus since the filing of application U.S. Ser. No. 001,192 that the cost of the apparatus could be reduced and the performance improved in terms of smoothness and quietness of the operation of the apparatus if the secondary energy absorption and release system was constantly engaged with the shuttle and intermittently engaged with the track assembly. Further, it was found that the function of the apparatus was not compromised in any way by configuring the primary energy absorption and release system so that it operates between the shuttle and one end of the track assembly rather than between the shuttle and both ends, although capability for operation between the shuttle and both ends is retained.

Therefore the primary objective of the subject invention is to provide exercise apparatus comprising a shuttle platform supported on rollers and operating on the tracks of a track assembly whereby reciprocating motion of the shuttle on the tracks is enabled, the apparatus further comprising primary and secondary energy storage and release apparatuses, the primary apparatus being constantly engaged with the shuttle and track assembly and the secondary system being constantly engaged with the shuttle and intermittently engaged with the track assembly. A further objective is that both energy storage and release systems be adjustable in terms of the at-rest position of the shuttle on the track assembly and the levels of forces in the energy storage and release systems at-rest and during operation.

SUMMARY OF THE INVENTION

The apparatus comprises a platform called a shuttle because of its reciprocating motion in operation, supported by rollers on parallel tracks which are part of a track assembly. This assembly comprises structural elements for interconnecting the tracks and for engagement of the elements of energy storage and release systems which serve to bias the shuttle toward an at-rest position along the tracks. These systems comprise elastic cords. Those of the primary system are attached to the track assembly and shuttle and thus constantly engaged with both. They are attached between a point on the underside of the shuttle and one or both end members of the track assembly.

The elastic cord(s) of the secondary system and the mechanism of the secondary system are installed on the underside of the shuttle. The mechanism comprises an assembly termed the rebound assembly extending across the shuttle between the shuttle sides and configured to slide lengthwise of the shuttle in contact with guides. The at-rest location of the rebound assembly is determined by interconnection between it and attachment points on the shuttle located specific distances from it along the shuttle, interconnection by segments of one or more elastic cords routed between the rebound assembly and the attachment points on the shuttle. The attachment locations between the cord segments and the rebound assembly are adjustable and at least some of the locations of the attachment points of the cord(s) to the shuttle are adjustable. The adjustability of these attachment points enables adjustment of the forces in the cords effective both at rest and in operation. The inoperation adjustments are primarily related to force levels and secondarily to differentiating the spring rates in the head-to-foot direction and foot-to-head direction of the shuttle on the track assembly.

The engagement between the secondary system, specifically the rebound assembly, and the track assembly is effected by engagement of projections from the rebound assembly with structural stop members attached to the track assembly. The stop members are positioned so that they are engaged by the projections as the shuttle nears the limits of its travel along the tracks. After engagement the rebound assembly stopped while the shuttle continues to move, stretching the elastic cord(s) and producing forces which decelerate, stop and re-accelerate the shuttle in the opposite direction or assist the primary system in doing so if the primary system is set to operate at that point.

The primary energy storage and release system comprises elastic cords attached to the bottom of the shuttle and to the ends of the track assembly at various points along the cords, using ferrules on the cords engaging slots in the end structures of the track assembly. These cords may be connected, and thus constantly engaged during operation, between the shuttle and one end of the track assembly, the shuttle and the other end of the track assembly or the shuttle and both ends. The system functions to bias the shuttle and its occupant toward a position along the tracks between its ends, the forces in the cord(s) serving to decelerate, stop and re-accelerate the shuttle at each end of its travel along the tracks, aided by the secondary system when necessary.

The shuttle is fitted on its top side with cushions, pads, straps and the like, appropriately shaped, sized and positioned to secure a user securely and comfortably in the supine position on the shuttle, feet toward one end of the track assembly, head toward the other. A foot rest may be mounted at the foot end of the track assembly and handles are attached by lengths of line to the head end. In operation, the user sets the shuttle into reciprocating motion on the tracks by pulling with one or both hands on the handles attached by cords to the head end and by foot pressure on the foot rest if one is used. It has been established that the repetitious accelerations and decelerations of the user provides clear benefits in terms of exercise of the parts of the body for producing and resisting the accelerations and decelerations. The forces achieved may exceed the force of gravity and the shuttle is equipped with supports and restraints for stabilizing the position of the user on the shuttle. The exercise provides cardiovascular stimulation, passive exercise of all components of the body and the active exercise of initiating and maintaining shuttle motion.

The apparatus is described in more detail below with reference to the attached drawings.

DETAILED DESCRIPTION OF THE INVENTION

Figure 1:
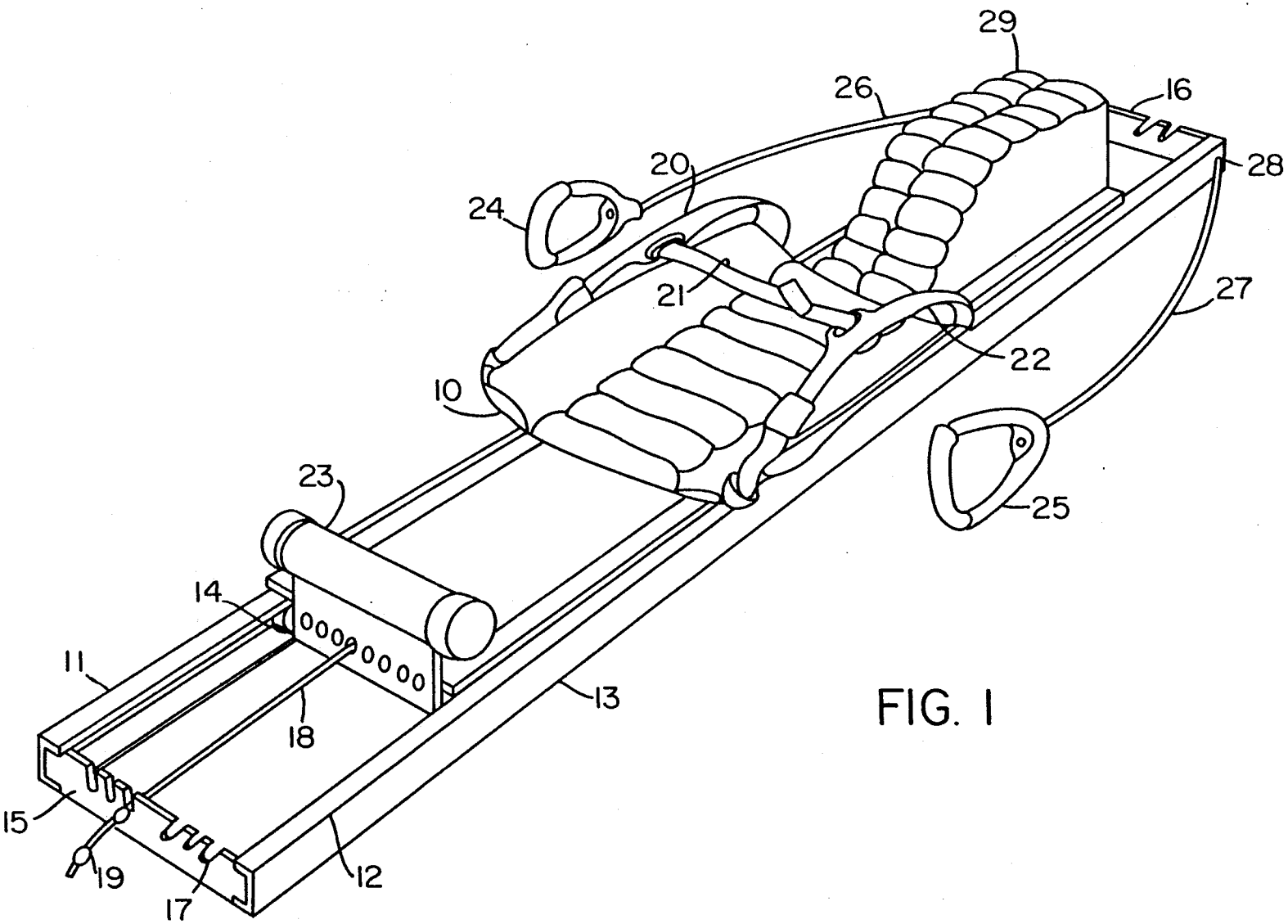
FIG. 1 is a perspective view of the apparatus.

Referring to FIG. 1, shuttle 10 is supported in channel shaped tracks 11 and 12 of main frame 13 on rollers, roller 14 being visible. The tracks are structurally attached to each other by end pieces 15 and 16. The end pieces are slotted, slot 17 being typical, to receive elastic cords, cord 18 being typical. Several ferrules, ferrule 19 being typical are attached spaced apart starting near the ends of each cord so that the tension in the cords can be adjusted according to which ferrules are engaged in the slots in the end piece. The cords are part of the primary energy storage and release apparatus. In this view no cords are installed at the head end. They are attached to the underside of the shuttle and tend to move the shuttle toward end piece 15, the foot end of the apparatus. In operation a user lies back down on the shuttle, held in place by straps 20, 21 and 22, with feet on rest 23. Handles 24 and/or 25 are grasped and the shuttle is moved away from the foot end, against the force in the primary energy storage and release cord(s), by users pulling on cords 26 and 27 which attach the handles to the main frame at point 28 and 29 (not visible in this view). At the appropriate point the user stops pulling on the handle(s) and the cords decelerate and stop the shuttle and user and accelerate toward the foot end. Again at one appropriate point the shuttle and user are decelerated, stopped and again accelerated away from the foot end by the user pulling on the handle(s) and, in some instance by the secondary energy storage and release apparatus 30 shown in FIG. 2. It will be understood that this apparatus also, in some instances, helps decelerate, stop and re-accelerate the shuttle and user at the extremes of the shuttle's excursions.

Figure 2:
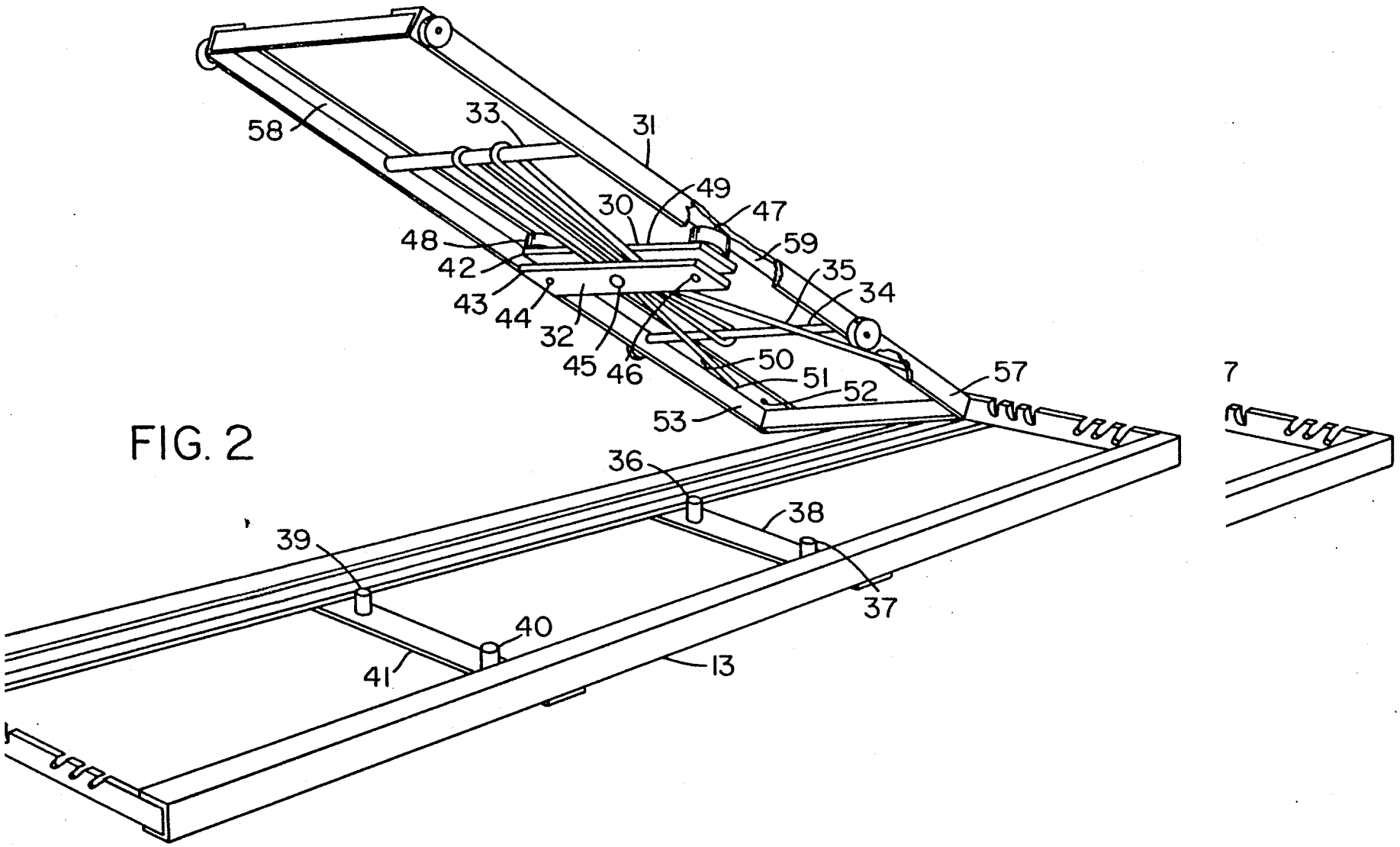
FIG. 2 is a schematic representation showing the secondary energy storage and release system.

Referring to FIG. 2, main frame 13 is shown viewed from above and shuttle frame 31 from below. The apparatus 30 is also known as the rebound apparatus and comprises rebound assembly 32, crossbars 33 and 34 and elastic cord 35 on the shuttle frame and stops 36 and 37 attached to crossbar 38 and stops 39 and 40 attached to crossbar 41, crossbars 38 and 41 being attached to the mainframe.

Rebound assembly 32 comprises plates 42 and 43 attached to each other by fasteners 44, 45 and 46. Fasteners 44 and 46 also attach slide blocks 47 and 48 to the upper surface 49 of plate 42. The elastic cord is attached at one of its ends to one of holes 50, 51 or 52 in sidebar 53 of the shuttle frame and at its other end to one of holes 54, 55 or 56 (not shown) in sidebar 57 of the shuttle frame. The cord is routed from one end between plates 42 and 43, over crossbar 33, back between the plates, over crossbar 34, between the plates again, over crossbar 33 again and between the plates again to its other end. The rebound assembly may be positioned anywhere between the crossbars and then clamped to the cord(s) by tightening fasteners 44, 45 and 46. The performance of the rebound apparatus is adjusted by the number of wraps around the crossbars and resultant passes between the plates, the selection of attachment points for the ends and the positioning of the plates on the cord(s).

In operation, the rebound apparatus engages the main frame via the stops and the crossbars to which they are attached when the shuttle has moved along the mainframe far enough for the rebound assembly plates to contact one set of stops or the other. When the shuttle moves far enough toward the foot end, the rebound assembly engages stops 39 and 40 and the cord segments between crossbar 34 and the rebound assembly are stretched providing force tending to slow down, stop and then help re-accelerate the shuttle toward the head end. When the shuttle has moved far enough in that direction, the rebound assembly engages stops 36 and 37 and the cord segments between crossbar 33 and the rebound assembly are stretched to provide force to help decelerate, stop and re-accelerate the shuttle. Whenever the cord segments on one side of the rebound assembly are stretched, those on the other side are relaxed, possibly to the fully slack condition. The slide blocks guide the rebound assembly between the side bars which are right angle shaped in crossection. The crossbars are located so that a component of the forces in the cord holds the rebound assembly against the undersides of 58 and 59 on the side bars.

From this description it can be understood that the subject invention meets its objectives. The shuttle can be put into reciprocal motion along the tracks of the track assembly. The primary energy storage and release apparatus is permanently engaged between the shuttle and the track assembly. The secondary energy storage and release apparatus is constantly engaged with the shuttle and intermittently engaged with the track assembly. Both energy storage and release systems (apparatuses) are adjustable in terms of the at-rest position of the shuttle on the track assembly and the levels of forces in the energy storage and release systems at rest and during operation.

Further, it will be understood by those skilled in the art that while a preferred embodiment of the invention is described herein, other embodiments and modifications of the one described are possible within the scope of the subject invention, the scope being limited only by the attached claims.

What is claimed is:

1. An exercise apparatus comprising: a track assembly having a first end and a second end, and further comprising:

a first track, a second track, means for interconnecting said first and second tracks whereby said tracks are positioned parallel to each other, a platform for supporting a user in the supine position, means for attaching said platform to said track assembly whereby said platform is free to move between said first and second ends, primary energy storage and release means for in use biasing said platform toward a position on said track assembly, said primary storage and release means being in constant engagement with said platform and said track assembly, secondary energy storage and release means, said secondary means being attached to said platform and in constant engagement with said platform and intermittent engagement with said track assembly, whereby the effects of said engagement of said secondary means are supplemental to the effects of said primary means for biasing, means for adjusting the energy storage capacity of said primary means, and hand grippable means attached to said track assembly whereby hand applied forces can set said platform into oscillating motion on said track assembly.

2. An exercise apparatus comprising:

a track assembly having a first end and a second end, and further comprising:

a first track, a second track, means for interconnecting said first and second tracks whereby said tracks are positioned parallel to each other, a platform for supporting a user in the supine position, means for attaching said platform to said track assembly whereby said platform is free to move between said first and second ends, primary energy storage sand release means for in use biasing said platform toward a position on said track assembly, said primary energy storage and release means being in constant engagement with said platform and said track assembly, secondary energy storage and release means, said secondary means being attaching to said platform and in constant engagement with said platform and intermittent engagement with said track assembly, whereby the effects of said engagement of said secondary means are supplemental to the effects of said primary means for biasing, means for adjusting the energy storage capacity of said secondary means, hand grippable means attached to said track assembly whereby hand applied forces can set said platform into oscillating motion said track assembly.

3. The apparatus of claim 1, further comprising means for adjusting the energy release capacity of said secondary means for energy storage and release.

4. The apparatus of claim 1, wherein the platform includes a pair of longitudinally spaced apart frame members each of which extends transversely of the platform, wherein said secondary energy storage and release means comprises an elastic cord which extends longitudinally of the platform, said elastic cord engaging said frame members, and a movable transverse member connected to the elastic cord at a location between the two frame members, and said track assembly including stop means positioned to be contacted by said movable member during movement of the platform towards one of said ends, whereby such contact between the movable member and the stop means stops the movable member as the platform continues to move towards said end and in so moving puts tension into the elastic cord.

5. The apparatus of claim 2, wherein the platform includes a pair of longitudinally spaced apart frame members, each of which extends transversely of the platform, wherein said secondary energy storage and release means comprises an elastic cord which extends longitudinally of the platform, said elastic cord engaging said frame members, and a movable transverse member connected to the elastic cord at a location between the two frame members, and said track assembly including stop means positioned to be connected by said movable member during movement of the platform towards one of said ends, whereby such contact between the movable member and the stop means stops the movable member as the platform continues to move towards said end and in so moving puts tension into the elastic cord.

6. An exercise apparatus comprising:

a base assembly having first and second ends, a platform for supporting a user, means mounting said platform on said base assembly for back and forth movement relative to the ends of the base assembly, and said platform including a pair of longitudinally spaced apart abutments, elastic means extending longitudinally of the platform between said abutments, and a movable member connected to the elastic means at a location between the two abutments, stop means on said base assembly positioned to be contacted by said movable member during movement of the platform towards one of the ends of the base assembly, and wherein said contact between the movable member and the stop mean stops the movable member as the platform continues to move towards said end and in so moving puts tension into the elastic means.

7. The apparatus of claim 6, further comprising additional elastic means connected at one end to an end of the base assembly and at an opposite end to the platform, said additional elastic means being put into tension when the platform is moved away from said end of the base assembly.

8. The apparatus of claim 6, wherein said abutments are longitudinally spaced apart first and second cross bars which extend transversely of the platform, and wherein said elastic means is an elastic cord making multiple wraps around the two cross bars and including opposite ends which are attached to the platform.

9. The apparatus of claim 8, wherein said movable member comprises a pair of plates above and below mid portions of the elastic cord wraps, and connecting means between the plates for connecting them together and clamping them to the elastic cord wraps.

* * * * *

UNITED STATES PATENT AND TRADEMARK OFFICE
CERTIFICATE OF CORRECTION

PATENT NO. : 5,042,797
DATED : August 27, 1991
INVENTOR(S) : Gary A. Graham

It is certified that error appears in the above-identified patent and that said Letters Patent is hereby corrected as shown below:

Col. 1, line 9, "or" should be -- of --.

Col. 2, line 36, "inoperation" should be -- in-operation --.

Col. 2, line 47, insert -- is -- before "stopped".

Claim 1, col. 5, line 12, after "primary", insert -- energy --.

Claim 2, col. 5, line 46, "attaching" should be -- attached --.

Claim 3, col. 5, line 58, delete "release", and insert -- storage --.

Claim 5, col. 6, line 21, "connected" should be -- contacted --.

Signed and Sealed this

Ninth Day of March, 1993

*Attest:*

*Attesting Officer*

STEPHEN G. KUNIN

*Acting Commissioner of Patents and Trademarks*

UNITED STATES PATENT AND TRADEMARK OFFICE

CERTIFICATE OF CORRECTION

PATENT NO. : 5,042,797 Page 2 of 2

DATED : August 27, 1991

INVENTOR(S) : Gary A. Graham

It is certified that error appears in the above-identified patent and that said Letters Patent is hereby corrected as shown below:

Drawing sheet 2 has an overlap. Below is the figure as it should appear on "Sheet 2 of 2".

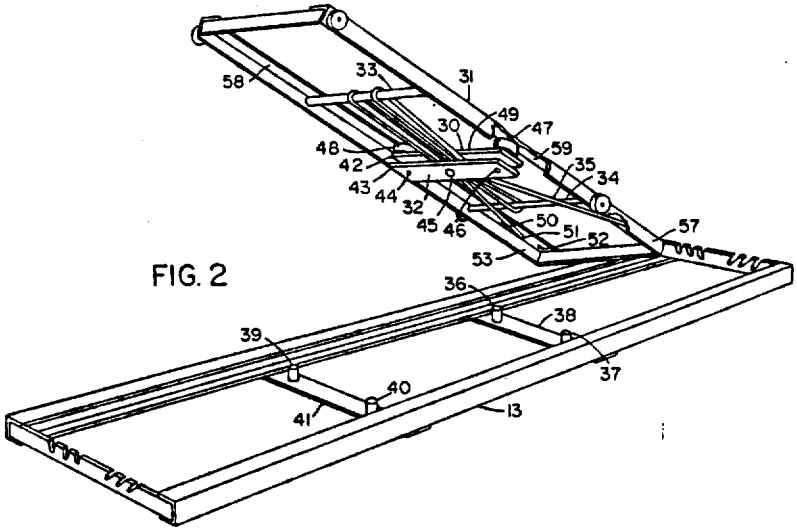

FIG. 2